US006058719A

United States Patent [19]

Cochran

[11] Patent Number: 6,058,719

[45] Date of Patent: May 9, 2000

[54] HEAT PUMP APPARATUS HAVING REFRIGERANT LEVEL INDICATION AND ASSOCIATED METHODS

[75] Inventor: Robert W. Cochran, Lakeland, Fla.

[73] Assignee: ECR Technologies, Inc., Lakeland, Fla.

[21] Appl. No.: 08/958,731

[22] Filed: Oct. 27, 1997

Related U.S. Application Data

[63] Continuation of application No. 08/508,827, Jul. 28, 1995, abandoned.

[51] Int. Cl.[7] ..... F25B 49/02

[52] U.S. Cl. ..... 62/129; 62/260; 62/503

[58] Field of Search ..... 62/125, 127, 129, 62/503, 260; 116/227, 276

[56] References Cited

U.S. PATENT DOCUMENTS

| | | | |
|---|---|---|---|
| 2,215,717 | 9/1940 | Rea | 62/115 |
| 2,873,714 | 2/1959 | Bauerlein | 116/227 X |
| 3,044,574 | 7/1962 | Feguson | 116/276 X |
| 3,153,913 | 10/1964 | Brody | 62/125 |
| 3,191,397 | 6/1965 | Kennedy | 62/125 |
| 3,987,294 | 10/1976 | Carlson | 116/227 X |
| 4,831,843 | 5/1989 | Cochran | 62/503 |
| 5,136,855 | 8/1992 | Lenarduzzi | 62/129 |
| 5,214,918 | 6/1993 | Oguni et al. | 62/129 X |

*Primary Examiner*—Harry B. Tanner
*Attorney, Agent, or Firm*—Allen, Dyer, Doppelt, Milbrath & Gilchrist, P.A.

[57] ABSTRACT

A heat pump apparatus maintains a desired constant amount of subcooling at an outlet of a condenser and a desired constant amount of superheat at an outlet of an evaporator, thereby requiring a charge defining level of refrigerant within a refrigerant storage container. A refrigerant level indicator is provided for indicating a level of liquid refrigerant to reside stored within the refrigerant container during operation of the heat pump. The superheat at an outlet of the evaporator is preferably controlled to be near zero degrees Fahrenheit so that the evaporator is fully flooded. Subcooling at an outlet of the condenser may also desirably be maintained at about zero degrees Fahrenheit. The refrigerant level indicator may be provided by a view port connected to the refrigerant container for permitting viewing of a level of liquid refrigerant. A liquid level sensor and associated display may also be used to indicate the level of refrigerant within the refrigerant container. Method aspects of the invention are also disclosed.

23 Claims, 3 Drawing Sheets

HEAT PUMP APPARATUS HAVING REFRIGERANT LEVEL INDICATION AND ASSOCIATED METHODS

This application is a continuation of Ser. No. 08/508,827 filed Jul. 28, 1995 now abandoned.

FIELD OF THE INVENTION

The present invention relates to the field of heating and/or air conditioning, and, more particularly, to an apparatus and method for facilitating determination of proper refrigerant charge in a heat pump apparatus.

BACKGROUND OF THE INVENTION

A typical heating or air conditioning system, such as a heat pump, includes an indoor heat exchanger, an outdoor heat exchanger, a compressor, and may include reversing valves to permit switching between heating and cooling modes. The compressor circulates refrigerant through the evaporator and condenser for cooling or heating. Moreover, the level of refrigerant charge in a heat pump apparatus is important in efficient operation of the heat pump apparatus and knowledge of the refrigerant level is important for diagnosing leaks or other problems. Unfortunately, conventional approaches for determining proper refrigerant charge may require complex valve arrangements and other components, and may be cumbersome or unreliable to use.

For example, one approach for determining proper refrigerant charge in a heat pump is disclosed in U.S. Pat. No. 3,153,913 to Brody entitled "Refrigeration System Including Charge Checking Means". The patent discloses a sight glass in a refrigerant charge container which is connected between two heat exchangers of a heat pump. A portion of the refrigerant charge will be stored in the container during the heating cycle, while the container also has a total capacity capable of containing substantially the entire optimum liquid refrigerant charge. The heat pump requires control means for controlling the pressure differential between the two heat exchangers, with a smaller circulating charge being desired on the heating cycle than on the cooling cycle. The container is connected between the indoor heat exchanger and flow restricting means. The container provides means for obtaining a difference in the effective or circulating charge of refrigerant on the heating and cooling cycles of operation of the heat pump.

For checking the charge as disclosed in U.S. Pat. No. 3,153,913, the heat pump is operated in the cooling mode and a normally open valve provided in the line connecting the indoor heat exchanger with container is closed, while a normally closed valve in the charge checking conduit is opened. Closing the valve prevents flow of liquid refrigerant to the indoor heat exchanger. In other words, the liquid refrigerant flowing into the container can no longer flow into the indoor heat exchanger, while any liquid refrigerant contained in the indoor heat exchanger will be evaporated and returned to the compressor through the low pressure conduits.

The refrigerant condensed in the indoor heat exchanger during the charge checking cycle flows through a capillary into the container where it is maintained in a liquid state by pressure. During the charge checking, any liquid refrigerant stored in any lower pressure portion of the system is transferred to the container. In addition, the sight glass is positioned in an upper portion of the container at the location of the desired liquid/gas interface level. Because it may be difficult to observe the liquid/gas interface with positive accuracy, another valve may be closed to prevent reverse flow of refrigerant from the container and the compressor so that a static reading is obtained. After the proper amount of charge is determined, the various valves are returned to their normal operating positions. In addition, the flow restrictor substantially reduces the refrigerant flow through the system during the charge measuring cycle relative to the flow under ordinary operation.

In other words, U.S. Pat. No. 3,153,913 requires operation in the cooling mode, a special container, manipulation of several valves, and other complexities to obtain an indication of a desired liquid/gas interface level relating to the refrigerant charge. The apparatus may be unnecessarily complex and the procedure too cumbersome to be of significant assistance in determining whether the refrigerant charge level is proper.

Other conventional approaches to determining proper refrigerant charge include a complete purge and measured refill of refrigerant for the heat pump apparatus, or the commonplace method of attaching gauges, taking pressure readings, obtaining indoor and outdoor temperatures, and applying the data so obtained to the equipment manufacturer's charging chart, all very cumbersome and time-consuming. Thus, conventional approaches to determining proper refrigerant charge have significant shortcomings in terms of time required, complexity, cost, and reliability.

SUMMARY OF THE INVENTION

In view of the foregoing background, it is therefore an object of the present invention to provide a heat pump apparatus and associated method for facilitating ready determination of proper refrigerant charge within the heat pump apparatus without the necessity of obtaining pressure and temperature data, or using charging charts and any other cumbersome and time-consuming method (such as purging the system and "weighing in" a specific charge).

It is another object of the present invention to provide a heat pump apparatus and associated method for facilitating ready determination of whether a heat pump has a proper refrigerant charge, while the heat pump remains operating and under various operating conditions of the heat pump apparatus.

It is yet another object of the present invention to provide a refrigerant charge control means and indicating apparatus and associated method for facilitating ready determination of proper refrigerant charge while a heat pump remains operating and under various operating conditions thereof.

These and other objects, features and advantages of the present invention are provided by a heat pump apparatus comprising refrigerant charge control means and liquid refrigerant flow control means within the heat pump apparatus such that the quantity of liquid refrigerant external to a charge control container is kept essentially constant, the liquid refrigerant in the apparatus being thereby stored in the said container, and refrigerant level indicating means for indicating a level of the remaining liquid refrigerant in the system, thus providing a system charge-defining level of liquid stored in the said refrigerant container during operation of the heat pump apparatus. Since the refrigerant container contains a charge defining level of liquid refrigerant, a level indicating means permits ready determination of proper refrigerant charge under various operating conditions of the heat pump apparatus.

In all heat pump apparatus, changing ambient and operating conditions, such as rain, snow, and indoor and outdoor temperature and humidity changes may cause large fluctuations in the operating pressures within the condenser and evaporator. However, as will be readily understood by those skilled in the art, if subcooling is held constant, the amount of liquid in the condenser will remain essentially constant despite wide pressure changes. Likewise, if superheat in the evaporator is held constant, the amount of liquid in the evaporator will remain essentially constant despite pressure changes. In typical conventional heat pumps, liquid refrigerant is often made to "back up" in the condenser in greatly varying quantities, with greatly varying amounts of subcooling resulting. Also, liquid refrigerant may be temporarily stored in the accumulator, in which case the liquid may be "metered" onto the compressor by way of the oil return means. In addition, some systems have "receivers" in which varying amounts of liquid refrigerant may be stored during operation, while the present invention has no receiver. Therefore, conventional systems do not provide a means for maintaining all liquid refrigerant external to a charge-defining container at an essentially constant quantity.

In the present invention, the said charge control means comprises the evaporator superheat control means which maintains a constant and relatively low amount of superheat at the outlet of evaporator so that the evaporator is constantly fully "flooded" and therefore contains an essentially constant amount of refrigerant. Along these lines, the said liquid flow control means comprises condenser subcooling control means connected in fluid communication between the condenser and evaporator for maintaining an essentially constant and low amount of liquid refrigerant in the condenser. Thus, in the present invention, all liquid refrigerant external to a refrigerant charge control is kept at an essentially constant quantity, such that all remaining liquid refrigerant is stored within the said charge control container. Therefore, the liquid level within the container is a charge-defining level. The addition of level indicating means allows a determination of a proper refrigerant charge in the heat pump apparatus.

With the amount of liquid refrigerant external held constant, the level of liquid within the charge-defining container will vary only with changes in operating conditions. In general, when operating pressures are high, more of the refrigerant will be in vapor form and the liquid level in the container will be relatively low. Conversely, when pressures are low and less refrigerant is in vapor form, the level in the container will be relatively high.

In one embodiment of the apparatus, the refrigerant level indicating means may comprise a view port connected to the refrigerant container for permitting viewing of a level of liquid refrigerant. A light may also be provided for illuminating an interior of refrigerant container to further facilitate viewing of the liquid refrigerant level within the refrigerant container. In addition, level indicia means may be provided in an interior of the refrigerant container for comparing the viewed liquid refrigerant level to indicia markings thereby indicating the status of the refrigerant charge. More particularly, the level indicia means may include a median mark for indicating proper charge at median operating pressures, as well as maximum and minimum marks for indicating proper charge levels at respective lower and higher operating pressures, for example.

In other embodiments of the invention, the refrigerant level indicating means may include liquid level sensing means associated with the refrigerant container for sensing a level of liquid refrigerant. Display means is preferably connected to the level sensing means for displaying the sensed level of liquid within the refrigerant container. The liquid level sensor may be coupled to a display, such as a bargraph display, for graphically indicating a level of liquid refrigerant within the refrigerant container. As discussed above with respect to the embodiment including a view port, the display means may include a median mark or indicia, as well as maximum and minimum indicia for indicating proper charge levels at respective operating pressures, for example.

The level sensing means may be provided by a float sensor, or conduction sensing means, or other liquid level sensor. The conduction sensing means may preferably be provided by a plurality of conductors extending into an interior of the refrigerant container at progressively increasing depths. Accordingly, the level of liquid may be readily determined by how many, or which, conductors define a conductive path through the conductive liquid refrigerant dependent upon its level in the refrigerant container.

A method aspect of the present invention is for facilitating ready determination of proper refrigerant charge of a heat pump apparatus under various operating conditions; and wherein the heat pump apparatus comprises an evaporator, a condenser, and a compressor for recirculating refrigerant through the evaporator and condenser. The method preferably comprises the steps of: maintaining a constant amount of superheat at an outlet of the evaporator and therefore a constant amount of liquid refrigerant within the evaporator, maintaining a constant amount of subcooling at an outlet of the condenser, and therefore a constant amount of liquid refrigerant within the condenser, thereby storing a charge defining level of liquid refrigerant within a refrigerant container during operation of the heat pump apparatus, and indicating a level of liquid refrigerant stored in the refrigerant container.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternate embodiments.

Figure 1:
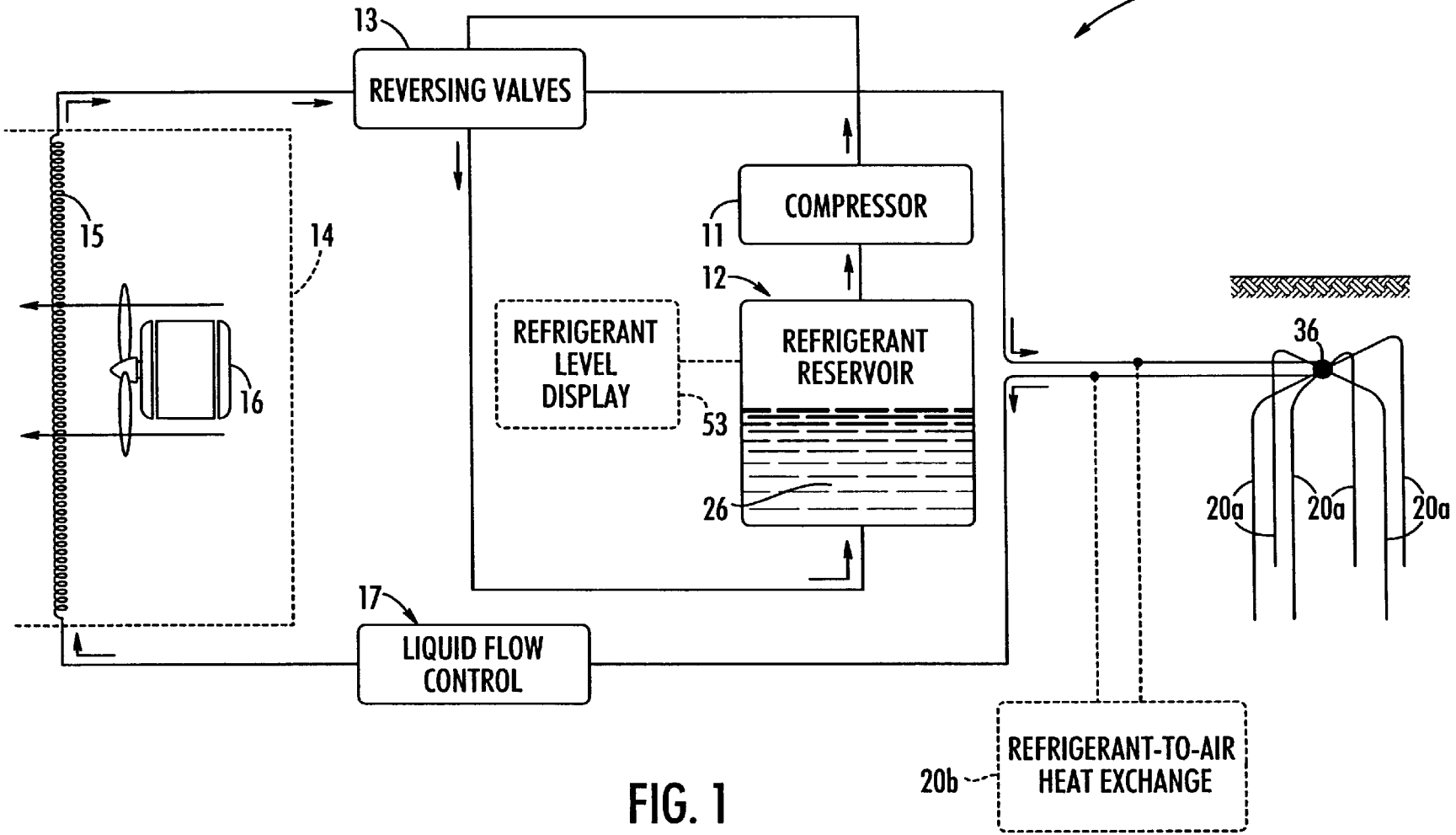
FIG. 1 is a schematic block diagram of the heat pump apparatus in accordance with the present invention.
Figure 3:
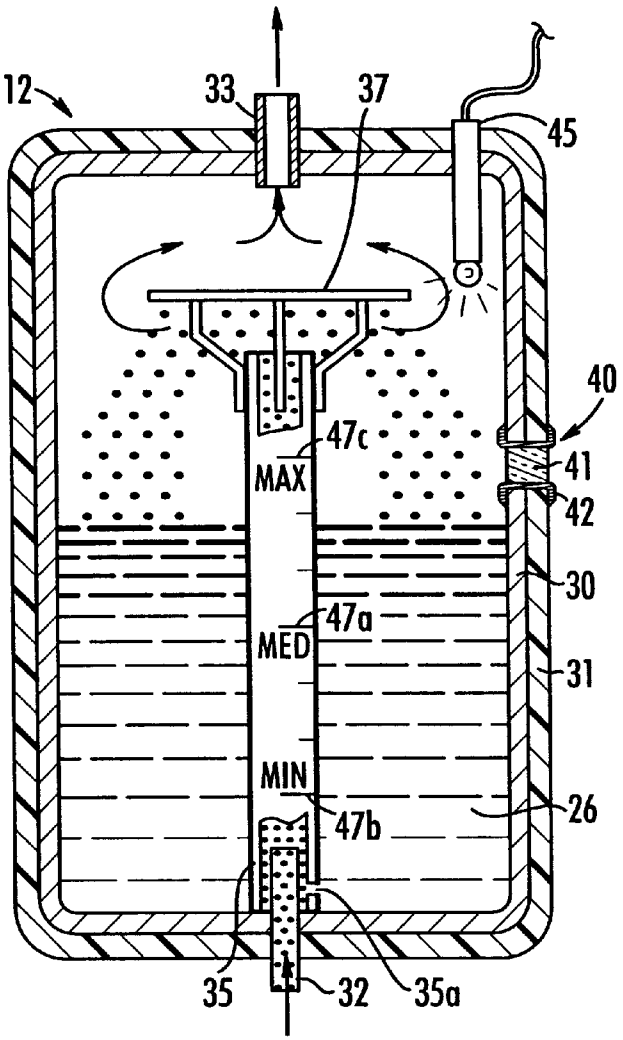
FIG. 3 is a schematic cross-sectional view of a first embodiment of a refrigerant charge control and level indicating apparatus in accordance with the present invention.
Figure 2:
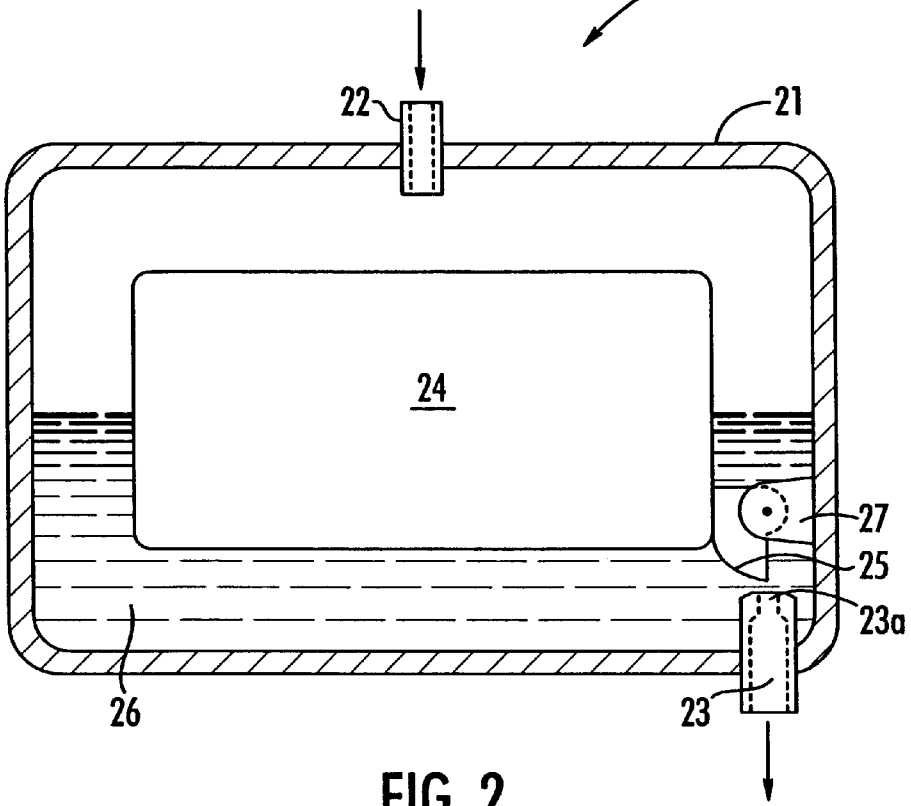
FIG. 2 is a schematic cross-sectional view of a liquid refrigerant flow control valve as may be used in an embodiment of the apparatus in accordance with the present invention.

Referring now initially to FIGS. 1–3, a first embodiment of the heat pump apparatus 10 and its operation in accordance with the present invention are described. The heat pump apparatus 10 includes an air handler 14 which, in turn, includes a blower 16 and a second heat exchanger 15 as would be readily understood by those skilled in the art. In the illustrated embodiment, the compressor 11 circulates refrigerant through the first heat exchanger, a plurality of earth tap heat exchangers 20*a* via the illustrated manifold 36, and through the second heat exchanger 15 via the liquid flow control valve 17. As would also be readily appreciated by those skilled in the art, the first heat exchanger may alternately be provided by a conventional refrigerant-to-air heat exchanger 20*b* rather than buried earth tap heat exchangers 20*a*, it being understood that an apparatus embodiment including earth tap heat exchangers may be even more susceptible to varying refrigerant charge requirements than a refrigerant-to-air heat exchanger 20*b*.

The illustrated heat pump apparatus 10 includes conventional reversing valves 13 for permitting selective operation of the apparatus in either a heating or cooling mode, as would be readily understood by those skilled in the art. Accordingly, for clarity of illustration, operation of the heat pump apparatus 10 will be described further herein as operating in the cooling mode, that is, with the second heat exchanger 15 operating as an evaporator and the first heat exchangers 20*a* (or alternatively 20*b*), operating as a condenser. Those of skill in the art will readily also appreciate operation in the heating mode.

The heat pump apparatus 10 illustratively includes condenser subcooling control means for maintaining a desired constant amount of subcooling at an outlet of the condenser 20*a*and therefore a constant amount of liquid refrigerant within the condenser, and evaporator superheat control means for maintaining a desired constant amount of superheat at an outlet of the evaporator 15 and therefore a constant amount of liquid refrigerant within the evaporator. In other terms, the subcooling control and superheat control means may be considered as defining a portion of refrigerant control means.

In the illustrated embodiment, the condenser subcooling control means may be provided by a float-type liquid flow control valve 17 (FIG. 2). The liquid flow control valve 17 includes a housing 21, and an inlet tube 22 and an outlet tube 23 in fluid communication with an interior of the housing. A float 24 has one end pivotally connected to an interior portion of the housing 21 by a suitable bracket 27. A control body 25 is attached to the float 24 and moves with the float to control liquid refrigerant flow exiting through a closely spaced liquid exit orifice 23*a* defined by the outlet tube 23.

In the actual construction of the liquid flow control valve 17, the space between the housing 21 and the float is small, such that only a very small portion of the total refrigerant charge resides as a liquid within the said housing, therefore the amount of liquid within the housing may be considered to be essentially constant, from a system perspective. The higher the level of liquid refrigerant 26 within the housing 21, the more liquid refrigerant is allowed to exit through the exit tube orifice 23*a* so that a predetermined amount of subcooling is maintained at the outlet of the condenser 20 and therefore an essentially constant amount of liquid refrigerant within the condenser. For example, the liquid flow control valve 17 may desirably maintain less than five degrees Fahrenheit of subcooling at an outlet of the condenser 20, more preferably less than one degree of subcooling, and most preferably about zero degrees of subcooling.

A preferred embodiment of the liquid flow control valve 17 is further described in U.S. Pat. Nos. 4,665,716 and 4,573,327, assigned to the assignee of the present invention, and the entire disclosures of which are incorporated herein by reference in their entirety. As would be readily understood by those of skill in the art, other types of mechanical or electrically operated subcooling control valves may be used in place of the illustrated liquid flow control valve 17, to hold a constant amount of liquid refrigerant within the condenser.

The evaporator superheat control means may maintain superheat at the outlet of the evaporator 15 so that the evaporator is substantially fully flooded, and with substantially no unevaporated refrigerant leaving the evaporator. For example, the superheat is preferably maintained to less than five degrees Fahrenheit, more preferably less than one degree Fahrenheit, and most preferably at about zero degrees. In either case, the amount of liquid refrigerant in the evaporator is held essentially constant. A preferred embodiment of the evaporator superheat control means may be provided by the refrigerant reservoir 12 as illustrated and as further described in the above mentioned patents assigned to the assigned of the present invention.

More particularly, the illustrated refrigerant reservoir 12 advantageously provides both control of the superheat of the evaporator 15, and a refrigerant container 30 for storing a charge defining level of liquid refrigerant 26 during operation of the heat pump apparatus 10 under different or varying operating conditions. The refrigerant container 30 may preferably be surrounded by an insulating layer 31. An inlet tube 32 and outlet tube 33 are connected in fluid communication with the container 30 in lower and upper portions, respectively, as illustrated. A vertical tube 35 extends through a medial portion of the container 30. The vertical tube 35 includes a lower opening 35*a* in a sidewall thereof to permit liquid refrigerant to enter the interior of the tube. Accordingly, refrigerant from the evaporator 15 passes through liquid refrigerant within the tube 35 so that refrigerant from the evaporator is collected and some of the stored liquid may be evaporated if the arriving refrigerant is superheated, thereby increasing refrigerant in active circulation to eliminate the superheat. A deflector plate 37 adjacent the upper opening of the vertical tube 35 redirects upward traveling refrigerant toward the adjacent interior walls of the refrigerant container 30.

Other shapes or configurations for the refrigerant container 30 are also contemplated by the present invention. In particular, further description of the operation, advantages, features and alternate embodiments of the refrigerant reservoir 12, as well as its synergistic functioning with the liquid flow control valve 17, may be found in the above mentioned U.S. Pat. Nos. 4,665,716 and 4,573,327, assigned to the assignee of the present invention.

If a conventional heat pump apparatus is charged with an optimum charge for medium operation pressures, relatively little liquid refrigerant is stored in the condenser when the system is operated at medium pressures. At lower operating pressures, the thus charged heat pump apparatus will store greatly varying amounts of liquid refrigerant in the condenser, thereby wasting a portion of the condenser, and subcooling the stored liquid refrigerant. Unless the condenser is substantially oversized, which is not usually economically desirable, a loss of operating efficiency results from the unnecessary condenser subcooling.

Conversely, if a conventional heat pump apparatus is charged at medium operating pressures with an optimum charge for such conditions, the heat pump, when operated at higher pressures, may have an inadequate amount of liquid refrigerant and little or no liquid refrigerant stored in the condenser. Accordingly, blow-through of uncondensed vapor at the outlet of the condenser may occur resulting in a loss of efficiency.

In contrast, in the heat pump apparatus 10 according to the present invention, the refrigerant reservoir 12 cooperates with the liquid flow control valve 17 to maintain an essentially constant amount of liquid refrigerant in both the condenser and evaporator, to maintain a desired amount of refrigerant within active circulation, while storing inactive liquid refrigerant 26 within the refrigerant container 30. Thus, an optimum amount of refrigerant charge is in active circulation throughout variations in heat pump operating conditions, and, moreover, a system charge defining amount of liquid refrigerant is thereby stored within the refrigerant container 30.

The present invention advantageously includes refrigerant level indicating means operatively connected to the refrigerant container 30 for indicating a level of liquid refrigerant 26 stored therein during operation of the heat pump apparatus 10. Accordingly, ready and accurate determination of proper refrigerant charge of the heat pump apparatus 10 is facilitated while the heat pump apparatus is operating. One embodiment of the invention includes a view port 40 including a glass pane 41 and a mounting receptacle 42 suitable for high pressure operation and mounted in a sidewall portion of the container 30 as schematically illustrated in FIG. 3. The positioning of the view port 40 may be readily determined by those skilled in the art based upon the selected configuration for the refrigerant container 30, and may be advantageously positioned in other portions of the container, such as the top portion, for example.

To facilitate viewing within the interior of the refrigerant container 30, a user operable light 45 may also be provided as schematically illustrated in FIG. 3. In addition, indicia, such as the illustrated horizontal marks 47*a–c* on the vertical tube 35, may be provided on the tube or any other surface within the container 30. The indicia permits a service technician to quickly determine whether the refrigerant level is at a desired operating level by comparison with the indicia.

More particularly, as shown in the illustrated embodiment, the indicia may include a median level mark 47*a* which correlates to a proper refrigerant charge at median operating pressures—for example, a sum of compressor 11 inlet and outlet pressures of about 365 psi. A minimum mark 47*b* may be provided to indicate a proper refrigerant charge level at about 500 psi combined pressure, and a maximum mark 47*c* corresponding to a combined pressure of about 230 psi. As would be readily understood by those skilled in the art, the shape and/or capacity of the refrigerant container 30 could be altered to cause a smaller or greater vertical variation of liquid level from minimum to maximum.

As would also be readily understood by those skilled in the art, an experienced service technician may readily estimate where the refrigerant level should be in relation to the level indicia 47*a–c* based upon knowledge of the inside and outside temperatures, for example. Alternatively, the technician could readily connect pressure gages to the inlet and outlet of the compressor 11 to obtain a more exact determination of where the refrigerant level should be in relation to the indicia 47*a–c*. As yet another alternative, with proper sizing of the refrigerant container 30, the technician could simply charge the heat pump to the median level mark 47*a* for any operating conditions. In any event, ready determination of proper refrigerant charge is facilitated, such as to assist the technician in filling the heat pump apparatus 10 or troubleshooting the apparatus.

Figure 4:
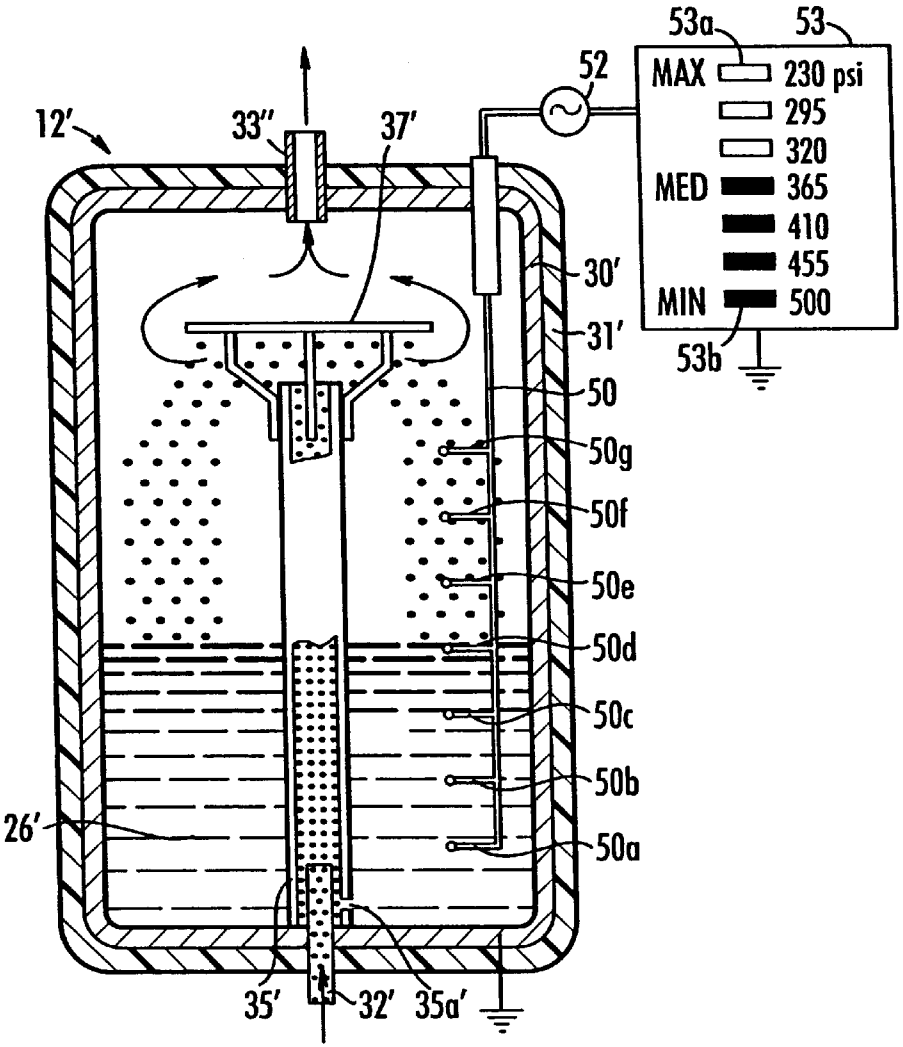
FIG. 4 is a schematic cross-sectional view of a second embodiment of a refrigerant charge control and level indicating apparatus in accordance with the present invention.

Referring now additionally to FIG. 4, another embodiment of the refrigerant reservoir 12' and the refrigerant level indication means in accordance with the invention is described. In this illustrated embodiment, a liquid level sensor and display provide the refrigerant level indication means. More particularly, a plurality of conductors 50 extend vertically into the refrigerant container 30'. The conductors are preferably insulated with uninsulated tip portions 50*a*–50*g* being exposed at predetermined vertical levels within the container 30. In other words, the plurality of conductors 50 extend into an interior of the refrigerant container 30' at progressively increasing depths so that the level of liquid is determined by which conductors define a conductive path through the conducting refrigerant liquid 26 and the conductive sidewalls of the refrigerant container.

In the illustrated embodiment, a voltage source 52 connected to the conductors may be used to drive a suitable display, such as the illustrated LCD bargraph display 53, to thereby indicate the level of liquid refrigerant 26' within the refrigerant container 30'. As shown in the illustrated embodiment, the sum of compressor inlet and outlet pressures, for example, could be identified alongside respective LCD elements 56*a* so that proper refrigerant charge could be readily correlated to a proper refrigerant charge based upon the heat pump operating conditions.

The plurality of conductors 50 provide conduction sensing means which may be readily used with conventional refrigerants which are typically more electrically conductive in the liquid phase as would be readily understood by those skilled in the art. The other elements of the embodiment illustrated in FIG. 4 include prime notation and correspond to similar elements described with reference to FIG. 3. Accordingly, these elements need no further description.

Figure 5:
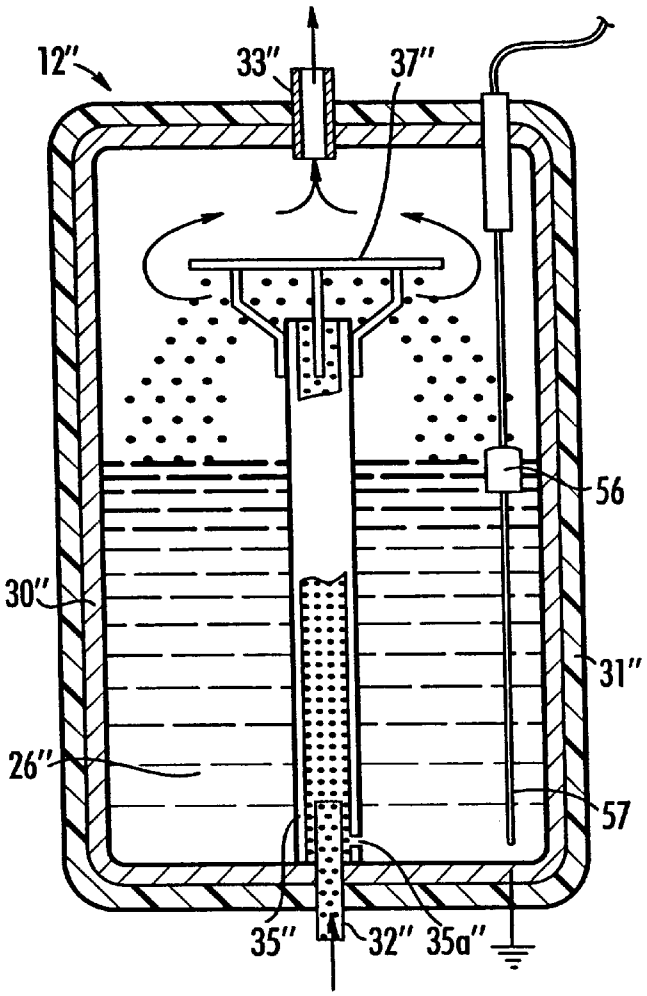
FIG. 5 is a schematic cross-sectional view of a third embodiment of a refrigerant charge control and level indicating apparatus in accordance with the present invention.

Referring now additionally to FIG. 5, yet another embodiment of the invention is illustrated. In this embodiment a float sensor is used to determine, or sense, the level of liquid refrigerant 26" within the refrigerant container 30'. The float sensor includes a movable float body 56 slidably mounted on a shaft 57 as would be readily understood by those skilled in the art. The output of the float sensor may be coupled to the LCD bargraph display 53 (FIG. 4), or any other suitable display as would be readily understood by those skilled in the art. The other elements of the embodiment illustrated in FIG. 5 include double prime notation and correspond to similar elements described with reference to FIG. 3. Accordingly, these elements need no further description.

A method aspect of the present invention is for operating a heat pump apparatus 10 and facilitating ready determination of proper refrigerant charge of the heat pump. The heat pump apparatus 10 is of the type preferably comprising an evaporator 15, a condenser 20*a*, and a compressor 11 for recirculating refrigerant through the evaporator and condenser. The method preferably comprises the steps of: maintaining a desired constant amount of superheat at an outlet of the evaporator 15, and therefore a constant amount of liquid refrigerant within the evaporator, maintaining a desired constant amount of subcooling at an outlet of the condenser 20*a*, and therefore a constant amount of liquid refrigerant within the condenser while storing a charge defining of liquid refrigerant within a refrigerant container 30 during operation of the heat pump apparatus 10 under various operating conditions; and indicating a level of liquid refrigerant 26 stored in the refrigerant container during operation of the heat pump apparatus to thereby facilitate ready determination of proper refrigerant charge. The step of maintaining a desired amount of superheat at an outlet of the evaporator 15 preferably comprises maintaining a relatively low superheat at the outlet of the evaporator so that the evaporator is substantially flooded.

As would be readily understood by those skilled in the art, the features of various embodiments of the invention could be advantageously assembled in various combinations. For example, the view port 40, light 45 and indicia means 47*a–c*, of the embodiment illustrated in FIG. 3 may be combined with either sensing and display embodiment of FIG. 4 or FIG. 5. Moreover, any of a number of liquid level sensors may be advantageously used in accordance with the present invention so that the refrigerant charge may be readily and accurately determined. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A heat pump apparatus facilitating ready determination of proper refrigerant charge despite variations in temperature and pressure in the apparatus, said heat pump apparatus comprising:

an evaporator, a condenser, a compressor for recirculating refrigerant through said apparatus, said evaporator and condenser experiencing variations in temperature and pressure;

a liquid flow control device connected to an outlet of said condenser, said liquid flow control device including condenser subcooling control means for maintaining a desired constant amount of subcooling at an outlet thereof and thus an essentially constant amount of liquid refrigerant within said condenser, such that the amount of liquid refrigerant in said condenser remains substantially constant despite the variations in temperature and pressure in said condenser;

a charge control device connected to an outlet of said evaporator, said charge control device including a liquid storage container, means for trapping liquid refrigerant arriving from said evaporator within said container, evaporator superheat control means for maintaining a desired constant amount of superheat at an outlet thereof and thus an essentially constant amount of liquid refrigerant within said evaporator, wherein said liquid flow control device and said charge control device, in combination, serve to force all liquid refrigerant in said apparatus and external to said container to remain at a substantially constant amount despite variations in temperature and pressure in said apparatus, thus requiring any remaining liquid refrigerant in said apparatus to reside within said container and establish a liquid level therein indicative of a total amount of refrigerant charge within the apparatus; and refrigerant level indicating means operatively connected to said container for indicating the level of liquid refrigerant stored therein during operation of said heat pump apparatus to thereby facilitate ready determination of proper refrigerant charge despite variations in temperature and pressure experienced by said evaporator and condenser.

2. An apparatus according to claim 1 wherein said refrigerant level indicating means comprise a view port positioned within said container.

3. An apparatus according to claim 1 wherein said refrigerant level indicating means further comprises a light for illuminating an interior of said refrigerant container to further facilitate viewing of a level of liquid refrigerant within said refrigerant container.

4. An apparatus according to claim 3 wherein said refrigerant level indicating means further comprises refrigerant level indicia means in an interior of said refrigerant container for facilitating determination of proper refrigerant charge by comparison of a level of liquid refrigerant to said refrigerant level indicia means.

5. An apparatus according to claim 1 wherein said condenser subcooling control means comprises liquid flow control means connected in fluid communication between said condenser and said evaporator for maintaining a relatively low amount of subcooling at the outlet of said condenser, and a constant amount of liquid refrigerant within said condenser.

6. An apparatus according to claim 1 wherein one of said condenser and said evaporator comprises an earth tap heat exchanger.

7. An apparatus according to claim 1 wherein said evaporator superheat control means further comprises a layer of thermal insulation surrounding said refrigerant container.

8. An apparatus according to claim 1 wherein said evaporator superheat control means further comprises:

an inlet formed on said liquid storage container connected in fluid communication with the outlet of said evaporator; and an outlet formed on said liquid storage container connected in fluid communication with an inlet of said compressor; and evaporating means within said container for directing refrigerant from said evaporator into thermal contact with liquid refrigerant stored therein.

9. An apparatus according to claim 1 wherein said liquid flow control device comprises:

a housing in fluid communication with said condenser and said evaporator;

a float carried within said housing;

a valve element operable with said float for controlling flow through said housing responsive to liquid levels within said housing and thus movement of said float.

10. The heat pump apparatus of claim 1, wherein said liquid flow control device comprises:

a liquid/vapor housing with an inlet port and an outlet port formed thereon;

a float positioned within said housing, said float being operatively connected to said housing such that said float rises when little, or no refrigerant vapor arrives in said housing, and said float falls when a substantial or large amount of vapor arrives in said housing; and liquid metering means operatively connected to said float and the outlet port, such that a rising float increases the rate of liquid refrigerant flow from the outlet port, and a falling float decreases the rate of liquid flow at the outlet port, with the result that said liquid flow control device reaches operating equilibrium with a small to moderate, and constant amount of vapor arriving at the inlet port, said liquid flow control device thereby requiring said condenser to remain at a zero subcooling condition, despite variations in temperature and pressure in said condenser, and thus requiring the amount of liquid refrigerant in said condenser to remain essentially constant despite the variations in temperature and pressure in said condenser.

11. The heat pump apparatus of claim 1, wherein said charge control device comprises:

an outlet port formed on said container, the outlet port operatively connected to the inlet of said compressor, such that liquid refrigerant in said container assumes a temperature corresponding to an inlet pressure of said compressor; and an inlet port formed on said container operatively connected to the outlet of said evaporator, for receiving liquid and vaporized refrigerant from the evaporator, such that any liquid refrigerant arriving from the evaporator is trapped in said container, and vapor arriving from the evaporator passes through said container to said compressor, the vapor making thermal contact with liquid refrigerant in said container, with the result that superheated vapor from the evaporator will be warner than the liquid stored in said container, and by thermal contact with the liquid will evaporate some of the liquid and require it to actively circulate through said apparatus, thereby increasing an effective system charge which in turn reduces subcooling in said evaporator until operating equilibrium is reached with zero superheating in the evaporator, despite changes in temperature and pressure in the evaporator, thus resulting in an essentially constant amount of liquid refrigerant in said evaporator.

12. A method for facilitating ready determination of proper refrigerant charge of a heat pump apparatus operating with variations in temperature and pressure in the heat pump apparatus comprising an evaporator, a condenser, and a compressor for recirculating refrigerant through the evaporator and condenser, the method comprising the steps of:

maintaining a constant amount of subcooling in the condenser and a constant amount of liquid refrigerant within the condenser under varying operating conditions of the apparatus;

maintaining a constant amount of superheating in the evaporator and a constant amount of liquid refrigerant within the evaporator under the varying operating conditions;

storing a liquid refrigerant, not actively recirculating through the apparatus, within a refrigerant container coupled within the apparatus for providing a charge defining level of liquid refrigerant within the container during operation of the heat pump apparatus despite variations in temperature and pressure experienced by the evaporator and condenser; and detecting the level of liquid refrigerant stored in the refrigerant container during operation of the heat pump apparatus for facilitating ready determination of a proper refrigerant charge.

13. A method according to claim 12 wherein the step of maintaining a desired amount of superheat at an outlet of the evaporator comprises maintaining a relatively low superheat at the outlet of the evaporator so that the evaporator is substantially flooded.

14. A method according to claim 12 wherein the detecting step comprises the step of illuminating an interior of the refrigerant container to further facilitate viewing of a level of liquid refrigerant within the refrigerant container.

15. A heat pump apparatus facilitating ready determination of proper refrigerant charge despite variations in temperature and pressure in said apparatus, said apparatus comprising:

an evaporator, a condenser, and a compressor for recirculating refrigerant through said apparatus, wherein said condenser and evaporator experience variations in temperature and pressure;

a liquid flow control device connected to an outlet of said condenser, said liquid flow control device including means for controlling the amount of subcooling in said condenser to a preselected constant value, despite variations in temperature and pressure in said condenser, such that the amount of liquid refrigerant in said condenser remains essentially constant despite the variations in temperature and pressure in said condenser;

a charge control device connected to the outlet of said evaporator, said charge control device including a liquid storage container, means for trapping liquid refrigerant arriving from said evaporator within said container; and means for controlling the amount of superheating in said evaporator at a pre-selected constant value, despite variations in temperature and pressure in said evaporator, such that the amount of liquid refrigerant in said evaporator remains essentially constant despite the variations in temperature and pressure in said evaporator, wherein said liquid flow control device and said charge control device in combination serve to force all liquid refrigerant in said apparatus and external to said container, to remain at an essentially constant value, despite the variations in temperature and pressure in said apparatus, thus requiring the remaining liquid refrigerant in said apparatus to reside within said container, and establish a liquid level within said container, which level is indicative of the total and proper operating amount of refrigerant charge within said apparatus; and detecting means operable with said container for detecting and quantifying the amount of liquid refrigerant within said container and thus indicating the status of refrigerant charge within said apparatus.

16. The heat pump apparatus of claim 15, wherein said liquid flow control device comprises:

a liquid/vapor housing with an inlet port and an outlet port formed thereon;

a float positioned within said housing, said float being operatively connected to said housing such that said float rises when little, or no refrigerant vapor arrives in said housing, and said float falls when a substantial or large amount of vapor arrives in said housing; and liquid metering means operatively connected to said float and the outlet port, such that a rising float increases the rate of liquid refrigerant flow from the outlet port, and a falling float decreases the rate of liquid flow at the outlet port, with the result that said liquid flow control device reaches operating equilibrium with a small to moderate, and constant amount of vapor arriving at the inlet port, said liquid flow control device thereby requiring said condenser to remain at a near zero subcooling condition, despite variations in temperature and pressure in said condenser, and thus requiring the amount of liquid refrigerant in said condenser to remain essentially constant despite the variations in temperature and pressure in said condenser.

17. The heat pump apparatus of claim 15, wherein said charge control device comprises:

an outlet port formed on said container, the outlet port operatively connected to the inlet of said compressor, such that liquid refrigerant in said container assumes a temperature corresponding to an inlet pressure of said compressor; and an inlet port formed on said container operatively connected to the outlet of said evaporator, for receiving liquid and vaporized refrigerant from the evaporator, such that any liquid refrigerant arriving from the evaporator is trapped in said container, and vapor arriving from the evaporator passes through said container to said compressor, the vapor making thermal contact with liquid refrigerant within said container, with the result that superheated vapor from the evaporator will be warner than the liquid stored in said container, and by thermal contact with the liquid will evaporate some of the liquid and require it to actively circulate through said apparatus, thereby increasing an effective system charge which in turn reduces subcooling in said evaporator until operating equilibrium is reached with near zero superheating in the evaporator, despite changes in temperature and pressure in the evaporator, thus resulting in an essentially constant amount of liquid refrigerant in said evaporator.

18. A heat pump apparatus for facilitating ready determination of proper refrigerant charge in the apparatus, comprising:

a first heat exchanger for providing heat to said apparatus;

a second heat exchanger for extracting heat from said apparatus;

a compressor for recirculating refrigerant through said heat exchangers;

a first controller for controlling refrigerant flow through said first heat exchanger such that the amount of liquid refrigerant in said first heat exchanger remains essentially constant despite varying temperature and pressure within said apparatus;

a second controller for controlling refrigerant flow through said second heat exchanger such that the amount of liquid refrigerant in said second heat exchanger remains essentially constant despite varying temperature and pressure within said apparatus;

a refrigerant container operatively coupled within said apparatus for storing liquid refrigerant not in active recirculation through said apparatus, to thereby establish a level of liquid within said container, which level of liquid is indicative of a total refrigerant charge in said apparatus; and detecting means for detecting the level of liquid within said container.

19. A method for facilitating ready determination of proper refrigerant charge in a heat pump apparatus under varying operating conditions of temperature and pressure, the heat pump apparatus comprising an evaporator, a condenser, and a compressor for recirculating refrigerant through the evaporator and condenser; the method comprising the steps of:

maintaining a constant amount of subcooling in the condenser and constant amount of liquid refrigerant in the condenser under varying operating conditions;

maintaining a constant amount of superheating in the evaporator and a constant amount of liquid refrigerant in the evaporator under varying operating conditions;

storing liquid refrigerant not actively recirculating through the apparatus in a container coupled within the apparatus, to thereby provide a charge defining level of liquid refrigerant within the container; and indicating a level of liquid refrigerant stored in the container under varying operating conditions to thereby facilitate ready determination of proper refrigerant charge.

20. A method for facilitating ready determination of proper refrigerant charge within a heat pump apparatus, the apparatus comprising an evaporator, a condenser, and a compressor for recirculating refrigerant through said apparatus, wherein said condenser and evaporator experience variations in temperature and pressure, the method comprising the steps of:

connecting a liquid flow control device to an outlet of the condenser for controlling the amount of subcooling in the condenser to a preselected constant value, despite variations in temperature and pressure in the condenser;

connecting a charge control device to an outlet of the evaporator, the charge control device including a liquid storage container for trapping liquid refrigerant arriving from the evaporator;

controlling the amount of superheating in the evaporator at a pre-selected constant value, despite variations in temperature and pressure in the evaporator, such that the amount of liquid refrigerant in said evaporator remains essentially constant despite the variations in temperature and pressure in said evaporator, wherein said liquid flow control device and said charge control device in combination serve to force all liquid refrigerant in the apparatus and external to the container, to remain at an essentially constant value, despite the variations in temperature and pressure, thus requiring the remaining liquid refrigerant in the apparatus to reside within the container, and establish a liquid level within the container, which level is indicative of the total and proper operating amount of refrigerant charge within said apparatus; and detecting the amount of liquid refrigerant with in the container for indicating the status of refrigerant charge within the apparatus.

21. The method according to claim 20, wherein the liquid flow control device connecting step comprises the steps of:

providing a housing with an inlet port and an outlet port formed thereon;

positioning a float within the housing and operatively connecting the float such that the float rises when little or no refrigerant vapor arrives in the housing, and falls when a substantial or large amount of vapor arrives in the housing; and controlling liquid flow through the outlet port, such that a rising float increases the rate of liquid refrigerant flow from the outlet port, and a falling float decreases the rate of liquid flow at the outlet port, with the result that the liquid flow control device reaches operating equilibrium with a small to moderate, and constant amount of vapor arriving at the inlet port, the liquid flow control device thereby requiring said condenser to remain at a zero subcooling condition, despite variations in temperature and pressure in said condenser, and thus requiring the amount of liquid refrigerant in said condenser to remain essentially constant despite the variations in temperature and pressure in said condenser.

22. The method according to claim 20, wherein the charge control device connecting step comprises the step of:

connecting an outlet port of the container to an inlet of the compressor, such that liquid refrigerant in said container assumes a temperature corresponding to an inlet pressure of said compressor; and connecting an inlet port of the container to the an outlet of the evaporator, for receiving liquid and vaporized refrigerant from the evaporator, such that any liquid refrigerant arriving from the evaporator is trapped in the container, and vapor arriving from the evaporator passes through said container to the compressor, the vapor making thermal contact with liquid refrigerant in the container, with the result that superheated vapor from the evaporator will be warner than the liquid stored in the container, and by thermal contact with the liquid will evaporate some of the liquid and require it to actively circulate through said apparatus, thereby increasing an effective system charge which in turn reduces subcooling in said evaporator until operating equilibrium is reached with zero superheating in the evaporator, despite changes in temperature and pressure in the evaporator, thus resulting in an essentially constant amount of liquid refrigerant in the evaporator.

23. A method for determining a proper refrigerant charge in a heat pump apparatus including a compressor, a condenser, an evaporator operationally connected therein, the method comprising the steps of:

providing a total amount of refrigerant charge to the apparatus, wherein the total amount of refrigerant charge includes vapor and liquid refrigerant;

circulating an active portion of the total amount of refrigerant charge through the compressor, condenser, and evaporator;

retaining a remaining portion of the total amount of refrigerant charge in a refrigerant container for defining a level of inactive liquid refrigerant within the container;

maintaining a substantially constant amount of the liquid refrigerant within the active portion of the total amount of refrigerant charge circulating through the apparatus;

allowing an amount of vapor refrigerant within the active portion of the total amount of refrigerant charge to vary in accordance with temperature and pressure changes within the apparatus; and detecting a level of the inactive liquid refrigerant within the container for determining a proper refrigerant charge for the apparatus.

* * * * *